US005293200A

United States Patent [19]

Tsusaka

[11] Patent Number: 5,293,200

[45] Date of Patent: Mar. 8, 1994

[54] ELECTROSTATIC DEVICE FOR CHARGING A PHOTOSENSITIVE SURFACE

[75] Inventor: Shusaku Tsusaka, Nagoya, Japan

[73] Assignee: Brother Kogyo Kabushiki Kaisha, Nagoya, Japan

[21] Appl. No.: 997,910

[22] Filed: Dec. 29, 1992

[30] Foreign Application Priority Data

Feb. 18, 1992 [JP] Japan ..... 4-030911
Feb. 18, 1992 [JP] Japan ..... 4-030912

[51] Int. Cl.[5] ..... G03G 15/02

[52] U.S. Cl. ..... 355/219; 361/225; 361/229; 361/230

[58] Field of Search ..... 355/219, 210; 361/225, 361/229, 230; 250/324–326

[56] References Cited

U.S. PATENT DOCUMENTS

| | | | |
|---|---|---|---|
| Re. 33,633 | 7/1991 | Hosono et al. | 361/213 |
| 4,589,053 | 5/1986 | Hosono et al. | 361/213 |
| 4,709,298 | 11/1987 | Hosono et al. | 361/213 |
| 5,060,014 | 10/1991 | Adachi et al. | 355/219 X |
| 5,126,913 | 6/1992 | Araya et al. | 355/219 X |
| 5,140,371 | 8/1992 | Ishihara et al. | 355/219 |
| 5,144,521 | 9/1992 | Tagoku et al. | 361/225 |
| 5,146,281 | 9/1992 | Kisu | 355/219 |
| 5,168,309 | 12/1992 | Adachi et al. | 355/219 |
| 5,177,534 | 1/1993 | Kisu et al. | 355/219 |

*Primary Examiner*—R. L. Moses
*Attorney, Agent, or Firm*—Oliff & Berridge

[57] ABSTRACT

In an electrostatic device that uses a resistance film for electrifying a latent image holder in printing devices, such as a photo-copier or a facsimile, at least one electrode borders the resistance film. The electrostatic device confronts a latent image holder, having a cylindrical shape, across a narrow gap and along the length of the latent image holder. With this structure, applying D.C. voltage to the electrode electrifies the latent image holder via the resistance film. Since the resistance film and the electrode overlap each other, the potential on the latent image holder is dependent on the surface resistance rather than the volume resistance of the resistance film giving the electrostatic device an immunity from nonuniformity or flaws in the surface of the resistance film. In addition, an electrostatic device of this invention has a structural advantage over conventional scorotron devices. Since there is no conductive member for retrieving current, and current supplied to the electrode is discharged at the narrow gap with a very small leakage, the electrostatic device has high efficiency in current use, resulting in a substantially smaller amount of ozone generated in operation.

20 Claims, 8 Drawing Sheets

ELECTROSTATIC DEVICE FOR CHARGING A PHOTOSENSITIVE SURFACE

BACKGROUND OF THE INVENTION

1. Field of the Invention

The invention relates to an electrostatic device, and more particularly to an electrostatic device for use in an electro-photographic appliance such as a photocopier.

2. Description of Related Arts

As shown in FIGS. 11 and 12, an electrostatic device using a scorotron has been employed in conventional electro-photographic devices such as a laser printer or a photocopier.

The scorotron electrostatic device 150 has a shield casing 152 having a U-shaped cross section with an open face. A discharge wire 156 is provided in the center of the shield casing 152 between insulation blocks 154*a* and 154*b* on either end of the shield casing 152. Grid electrodes 158 are provided on the open face of the shield casing 152. The grid electrodes 158 are grounded via a varistor 160 with a voltage rating of about −680 volts.

When the scorotron electrostatic device 150 as described is used, the open face (the face with the grid electrodes) of the shield casing has to be kept parallel with the photo-sensitized drum 162 and a direct current voltage of −6 kv must be applied to the discharge wire 156 under fixed current control. In this condition, corona discharge occurs around the discharge wire 156, and negative ions created in the corona discharge pass through the grid electrode 158 and reach a photo-sensitized drum 162 giving an electrostatic charge to the surface of the photo-sensitized drum 162. As described above, since the grid electrodes 158 are grounded via a varistor 160, the ions flow to ground rather than to the photo-sensitized drum 162 when the potential on the surface of the photo-sensitized drum 162 nears the voltage rating of about −680 V.

However, the described scorotron electrostatic device has various shortcomings. First, from an environmental point of view, the scorotron electrostatic device has a fault in that the device ionizes oxygen in the atmosphere and creates ozone. The electrostatic device used in a laser printer has to be electrified with a negative charge due to the characteristic of toner particles, and the amount of ozone created in the corona discharge is significantly greater (by one decimal place) when the device is electrified with a negative charge rather than with a positive charge. Moreover, the amount of ozone created in the device is dependent on the current flow through the wire. The scorotron electrostatic device needs a current flow of −400 to −500 μA on the wire to collect a current flow of several-tens μA for properly electrifying the photo-sensitized drum. As a result, it creates a good deal of ozone. The density of the ozone reaches as high as 10 ppm when measured near the electrostatic device. Consequently, conventional laser printers had an ozone filter set in the exhaust duct for removing the ozone.

The low efficiency in current use mentioned above has resulted in a power unit having a large capacity, an ozone filter and an exhaust fan, thereby substantially increasing the cost of the products.

A second shortcoming is that silicon oil, used for removing toner in the fixing unit, evaporates into the air and is oxidized to be silicon oxide ($SiO_2$) that remains on the wire. The silicon oxide adhering to the wire causes an increase in the impedance on the surface of the photo-sensitized drum, interfering discharge, and resultant sag in the initial voltage at the surface of the drum that has a negative influence on the quality of the printed characters.

To solve the above-identified problems, a surface discharge device as shown in FIG. 13 is proposed. The surface discharge device 164 has an electrode 168 on a substrate 166 made of, for example, glass, and a resistance film 170 thereon. With this construction, applying voltage to the electrode 168 triggers the corona discharge over the surface of the resistance film 170, and the ions generated in the corona discharge electrify the photo-sensitized drum 162.

The surface discharge device 164 is manufactured, for example, by sputtering tantalum (Ta) to form a thin film on the surface of the glass and exposing to nitrogen (N) to form a tantalum nitride (TaN) resistance film on the surface of the electrode. Material other than TaN, such as titan oxide ($TaO_2$), can be used as a substitute Besides the sputtering method, amorphous silicon with impurities doped in the chemical vapor deposition (CVD) method can be used.

The electrostatic device using the surface discharge device 164, as described, can make an efficient use of the current, produce a lesser amount of ozone and requires a smaller power supply unit.

The conventional surface discharge electrostatic device had another inherent problem, that is, it had difficulty in controlling the resistance of the resistance film 170. Because the resistance film 170 has the electrode 168 on the side opposite to the discharge surface, it is extremely difficult to keep the resistance value in an optimal range by controlling the volume resistance measured across the thickness of the resistance film 170.

If the resistance is too low, a streamer discharge instead of a corona discharge occurs, thereby failing to properly electrify the photo-sensitized drum 162. The resistance film 170 must be made thicker to obtain a proper resistance value. However, the optimal resistance has a narrow range and forming thicker film using the sputtering process is costly.

What is worse, a tiny flaw on the resistance film 170 results in the current flowing from the electrode to the tiny spot which produces a concentration of the electric field. Under this condition, the streamer discharge occurs and the electrostatic device fails to electrify the photo-sensitized drum 162 properly.

SUMMARY OF THE INVENTION

It is an object of the invention to provide an electrostatic device which can cause a stable corona discharge and prevent the streamer discharge from occurring with relative ease through resistance control and the efficient use of the current.

To do so, the electrostatic device of the invention has a substrate provided along the long side of the latent image holding member having the resistance film provided thereon, an electrode extending along one of the long sides of the substrate is attached to a side portion of the resistance film, and a voltage applied to the electrode electrifies the electrostatic latent image holding member.

In the electrostatic device of the invention with the above described structure, applying voltage to the electrode provided only on one long side of the resistance film causes the corona discharge on the surface of the resistance film.

As described above, the electrostatic device of the invention facilitates resistance control and ensures a stable corona discharge. A variety of materials can be used for resistance film and a lack of uniformity in the thickness or other defects in the resistance film does not hinder stable corona discharge because the characteristics of the discharge are dependent on the surface resistance of the resistance film rather than volume resistance across the film.

Further, the electrostatic device of the invention can make an efficient use of the current, produce a lesser amount of ozone and require a smaller power supply unit.

BRIEF DESCRIPTION OF THE DRAWINGS

The invention will be described with reference to the figures, in which.

DETAILED DESCRIPTION OF THE PREFERRED EMBODIMENTS

Figure 1:
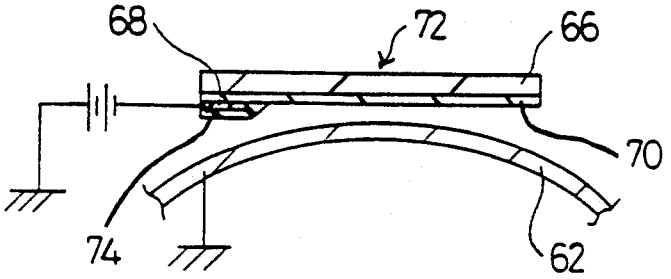
FIG. 1 is a cross-sectional view of the electrostatic device of a first embodiment.
Figure 2:
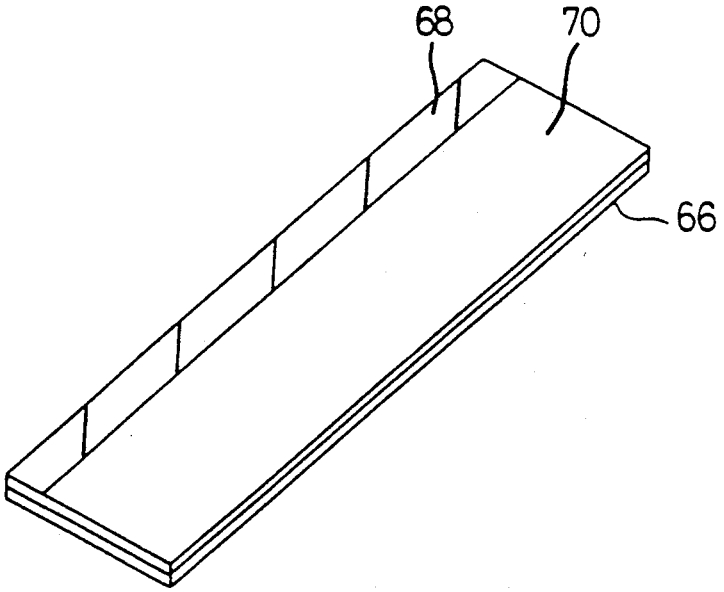
FIG. 2 is a perspective view of the electrode.

FIG. 1 shows a cross sectional view of the electrostatic device 72 in the preferred embodiment. A substrate 66 has a resistance film 70 covering the entire side facing a photo-sensitized drum 62, an electrode 68 is provided across the long side or along a part of the resistance film. The electrode 68 is covered with an insulation film 74. Insulation materials with a smooth surface such as glass are desirable for the substrate 66.

The electrode 68 is manufactured by sputtering aluminum over the entire side of the substrate with a cover over the part of the surface that is not to have the electrode 68 and removing the cover, after the sputtering process, to leave the electrode 68 only on the previously uncovered portion of the substrate. A layer as thin as 0.2 μm of aluminum will suffice for the required functionality of the electrode.

The resistance film 70 can be made of, for example, a metal oxide (e.g. $TiO_2$), or a metal nitride (e.g. TaN). There are various sputtering methods that may be used. A thin film of less than 1 μm can be produced by the D.C. magnetron reactive sputtering method with argon pressure set at $1\times10^{-4}$ to $3\times10^{-2}$ Torr and sputtering voltage set at 100 to 500 V D.C. Amorphous silicon with impurities doped in the plasma chemical vapor deposition (CVD) can be also employed as substitute for the sputtering method. The optimal surface resistance of the resistance film is $10^7$ to $10^9$ ohms.

The insulation film 74 can be formed by screen printing a resin belonging to polyimide, polyamide, phenol or polystyrene groups, and solidifying the resin using an ultraviolet light stiffening process or a thermal stiffening process. More definitely, for example, a polyimide group resin is generated after polymerization with tetracarvone anhydride or aromatic diamine. Polyimide insulation film is generated by screen printing a solution of intermediate polyamine on the electrode 68, drying the solution and coagulating the solution at 150 degrees celsius or higher. The polyimide insulation film generated in the above process has a dielectric strength of 120 k to 170 kV/mm which is sufficient for the insulation film in the invention. Polystyrene is generated by polymerizing styrene acquired in reaction between benzene and ethylene with the presence of a catalyst at a high temperature and a high pressure. The dielectric strength of the polystyrene is around 25 kV/mm.

The photo-sensitized drum 62, to be electrified by the electrostatic device 72, comprises, for example, an aluminum tube with an organic photo-sensitized material having a carrier generation layer (CGL) and a carrier transport layer (CTL) on the surface.

A D.C. voltage is applied to the electrode 68, after positioning the side of the electrostatic device 72 without the electrode 68 to confront the photo-sensitized drum 62 with a clearance of 0.3 to 0.6 mm between the electrostatic device 72 and the photo-sensitized drum 62, with the voltage kept at −3 to −4 kV and the photo-sensitized drum 62 electrified at −800 V.

Since the electrostatic device 72 is not a so-called reverse electrode system, deviation from the optimal volume resistance of the resistance film 70 has a less negative influence on the performance of the device. In addition, a flaw on the discharge surface or molecular dislocation of the resistance film does not cause streamer discharge.

In this embodiment, surface resistance of the resistance film between the electrode and the discharge surface determines the mode of discharge. Research by the inventor shows that a surface resistance of $10^8$ to $10^9$ ohm is optimal for causing the corona discharge. The optimal resistance is obtained by forming a thin film of 500 to 1000Å using a sputtering process. The electrostatic device of the above construction can be easily manufactured using a sputtering process.

Figure 3:
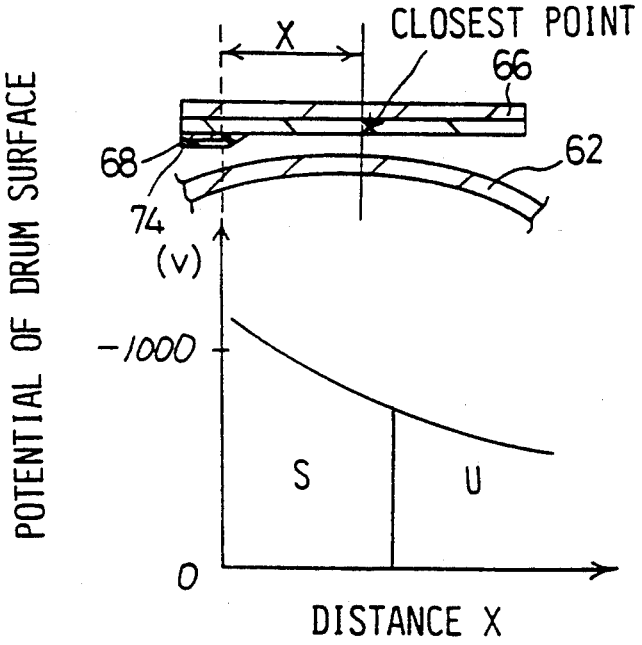
FIG. 3 is a diagram showing the electrostatic state.

FIG. 3 shows the potential on the surface of the photo-sensitized drum 62 when a D.C. voltage is applied to the electrode 68.

The initial potential on the surface of the photo-sensitized drum is illustrated in FIG. 3 in relation to the distance x from the electrode 68 to the point where the gap between the electrostatic device 72 and the photo-sensitized drum 62 is narrowest. The surface potential on the resistance film is below −1000 V when measured near the electrode. The surface potential declines as the distance between the electrode 68 and measuring point increases. The sag in the potential is greater when the resistance film 70 has a greater resistance value than that in the example portrayed.

The above analysis shows that the electrostatic potential on the surface of the photo-sensitized drum 62 is controlled by varying the distance x between the electrode 68 and the point over the narrowest gap. Accordingly, the electrostatic device of the invention is applicable to various systems having different process speeds or different electrostatic characteristics by varying the distance x.

Since the corona discharge is prone to be affected by temperature or humidity, the electrostatic characteristic deteriorates in a hot and humid environment. In order to compensate for the lowered performance caused by the environment, a thermo-hygro sensor 90 should be provided on the main body of the printer and the electrostatic device should slide, i.e., move to adjust the distance x to offset the drop in the potential resulting from changes in temperature and humidity.

Figure 4:
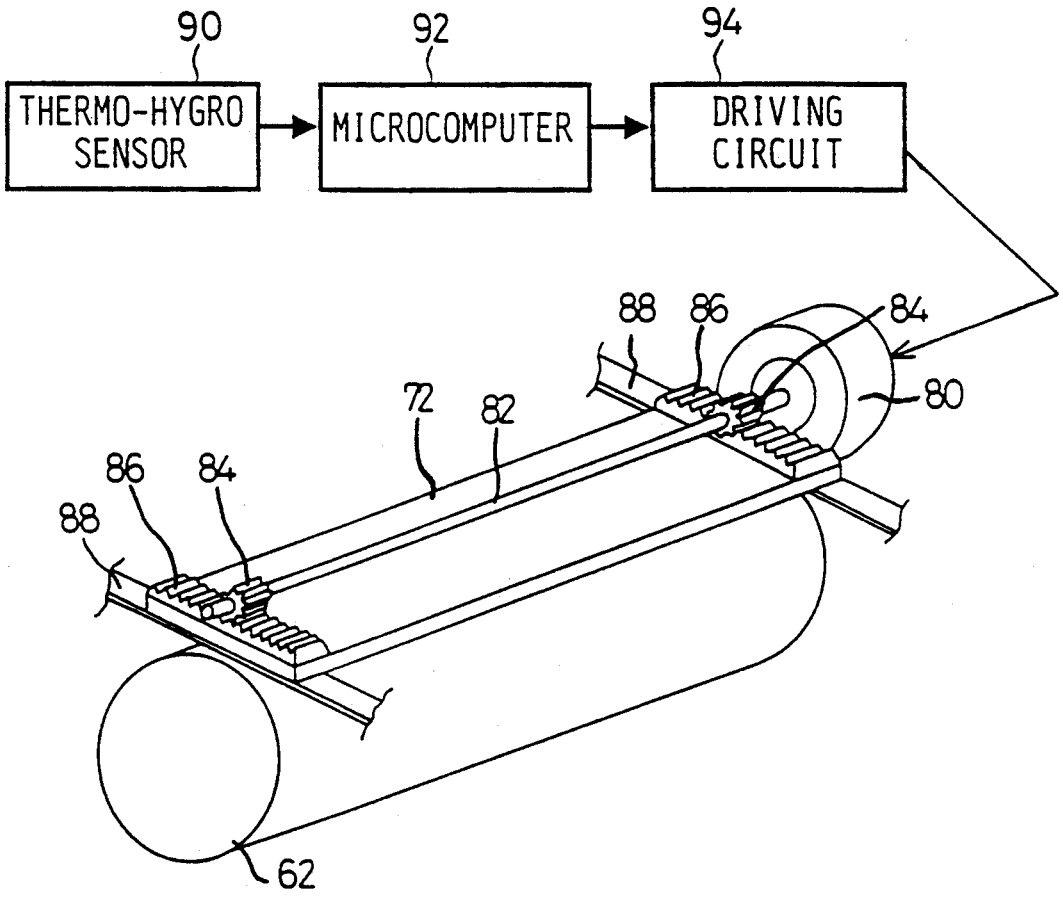
FIG. 4 is a perspective view depicting the sliding mechanism of the electrostatic device.

FIG. 4 shows the mechanism for automatically adjusting the distance x. A motor 80 is provided at one end of the electrostatic device 72. Two gears 84 are provided on a motor shaft 82 extending from motor 80. A rack 86 is provided on the reverse side of the electrostatic device 70 along each end. The racks 86 engage with the gears 84 and the electrostatic device 72 is supported by a supporting mounting 88 at each end.

In the structure described above, the microcomputer 92 calculates the distance x based on the reading of the thermo-hygro sensor and instructs the driving circuit 94 to drive the motor 80. Consequently, gears 84, attached to the motor shaft 82, engage with the racks 86 on the reverse side of the electrostatic device 72, moving the electrostatic device 72 a distance along the mounting 88 to adjust the distance x.

As described above, in the electrostatic device 72 of the invention, having a resistance film 70 on the side confronting the photo-sensitized drum and an electrode 68 abutting the resistance film for electrifying the photo-sensitized drum by applying a D.C. voltage, the volume resistance is easily kept within the optimal range because the electrode 68 is provided on part of the width of the electrostatic device 72 extending along the entire length, ensuring stable corona discharge and preventing streamer discharge resulting from nonuniform thickness or a defect in the resistance film. The initial potential on the photo-sensitized drum is controlled by shifting the electrostatic device relative to the photo-sensitized drum.

Figure 5:
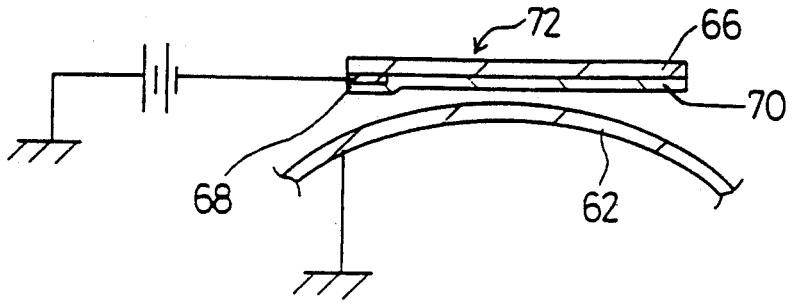
FIG. 5 is a cross-sectional view of the electrostatic device of a second embodiment.

FIG. 5 shows a second embodiment of the invention. In this embodiment, the electrode 68 is provided on the substrate 66 and the resistance film 70 covers the entire side of the electrostatic device 72.

With this structure, it is also possible to control the initial potential on the photo-sensitized drum by varying the distance x between the resistance film 70 and the closest point to the photo-sensitized drum 62 because the surface resistance of the resistance film 70 causes a sag in the potential.

Figure 6:
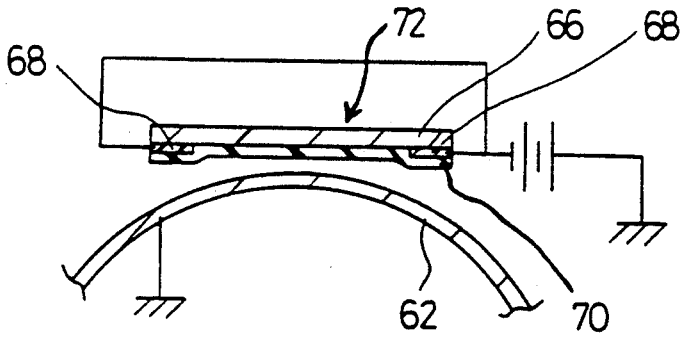
FIG. 6 is a cross-sectional view of the electrostatic device of a third embodiment.
Figure 7:
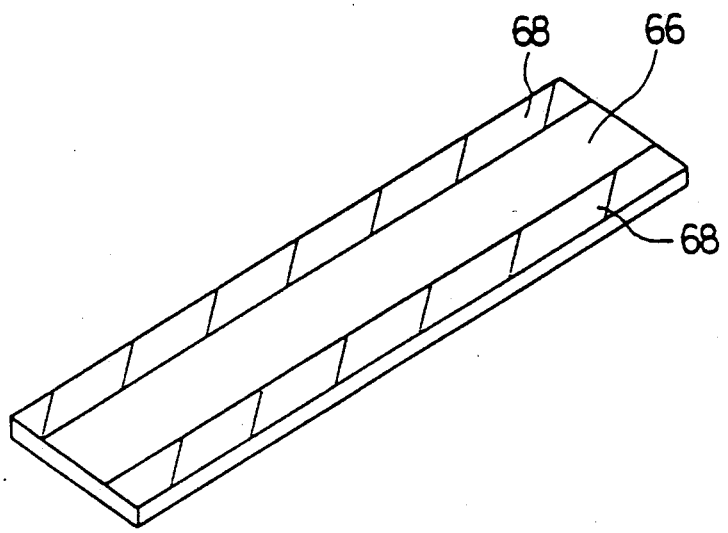
FIG. 7 is a perspective view depicting the shape of the third embodiment.

FIGS. 6 and 7 depict a third embodiment of the invention. In this embodiment, there are two electrodes 68 set in parallel on the side of the substrate 66 confronting the photo-sensitized drum 62. FIG. 7 shows the substrate 66 having the electrodes 68 on the surface of the resistance film 70. The optimal distance between the electrodes is about 7 mm to 15 mm. The resistance film 70, of FIG. 6, overlays the side having the electrodes 68.

Figure 8:
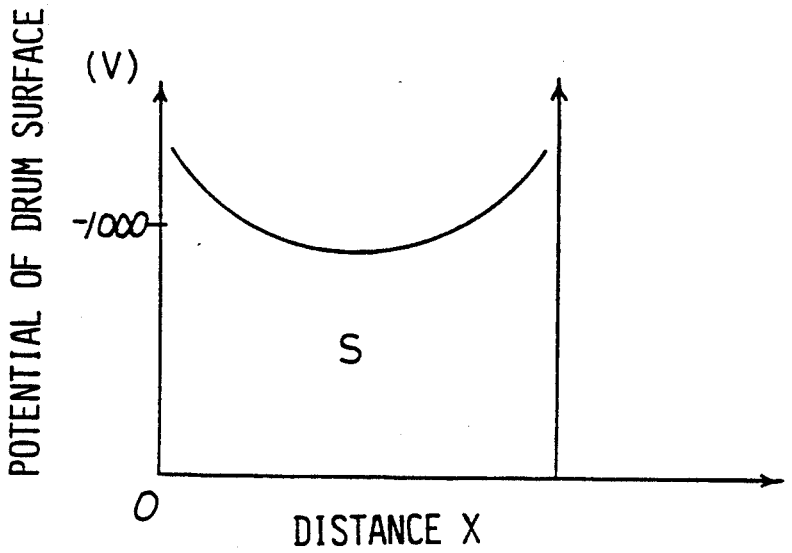
FIG. 8 is a diagram showing electrostatic potential using two electrodes.

The electrostatic status, with the D.C voltage applied to the electrodes 68, is illustrated in FIG. 8 in comparison to the first embodiment with only one electrode.

FIGS. 3 and 8 show that electrostatic potential near each electrode is below −1000 V, however, the potential sags sharply as the measuring point moves away from the electrode. The sag in the potential is greater for a resistance film with a greater resistance value. Discharge occurs in a stable corona discharge mode near the electrode, but the stability is gradually lost as the distance from the electrode increases. In FIG. 3, the entire domain is divided, for simplicity into a stable domain and an unstable domain. Deciding the optimal distance x for the electrostatic device 72 having one electrode 68 is critical because the potential on the surface sags sharply as the distance x increases.

FIG. 8 also shows the dependence of surface potential on the distance x. However, the two electrodes 68 complement each other by compensating for the unstable domain, enabling a stable discharge. Since the surface potential changes slowly in the middle between the two electrodes 68, a positioning error of the electrostatic device 72 relative to the photo-sensitized drum 62 has minimal negative effect on the stability of the corona discharge.

In the electrostatic device 72 with two electrodes, a function for controlling the electrostatic potential is realized with a resistance film having a fixed resistance value since the potential on the resistance film depends on the distance x. Accordingly, the electrostatic device 72 with a single electrode is applicable to devices with different process speeds or different electric characteristics.

Figure 9:
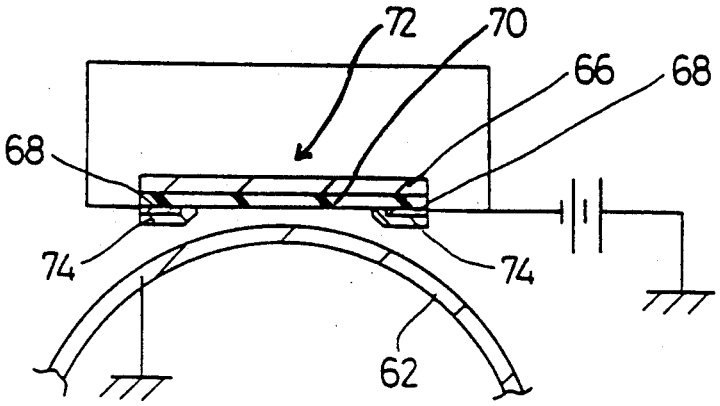
FIG. 9 is a cross-sectional view of the electrostatic device of a fourth embodiment.

FIG. 9 shows a fourth embodiment of the invention. In this embodiment, a resistance film 70 covering the entire side of the device is first overlapped on the side of the substrate 66 of the electrostatic device 72 confronting the photo-sensitized drum 62. Next, a pair of electrodes 68 are provided in parallel on the resistance film. In this structure, it is recommended that an insulation film 74 cover the electrodes 68 to prevent current leakage between the narrow gap between the electrodes 68 and the photo-sensitized drum 62.

This embodiment has the same effect as the embodiment illustrated in FIG. 6. Specifically, the insulation film is formed after sputtering TaN on the surface of the glass substrate 66, providing aluminum electrodes and covering the electrodes with polyimide tape. A D.C. voltage of −3 kV is applied to the electrodes 68, which are 3 mm wide with a distance between the electrodes 68 of 7 mm, and the gap between the electrostatic device 72 and the photo-sensitized drum 62 is set at 0.3 mm with the photo-sensitized drum electrified at −850 V.

Under the above conditions, the inflow current to the aluminum electrodes 68 measures −14 μA, and the inflow current to the photo-sensitized drum 62 is almost the same, which shows a current use efficiency of almost 100% that is achieved with the electrostatic device 72 of the embodiment.

Further, the ozone density near the electrostatic device is less than the detection limit of 0.01 ppm when using an ozone density meter. Although, an ozone filter (e.g. activated charcoal) was not used in this embodiment, the ozone could hardly be smelt. Thus, it was inferred the density of the ozone was very low.

In this embodiment, the electrodes are provided on the discharge side of the electrostatic device 72, therefore, it is necessary to keep the resistance of the resistance value in the optimal range by controlling the volume resistance. Unlike devices with the resistance value dependent on the volume resistance, higher resistance is obtained by making the resistance film thinner rather than thicker. Thus, the sputtering method, which is not suitable for forming a thick film, is a preferred method in this embodiment.

Figure 10:
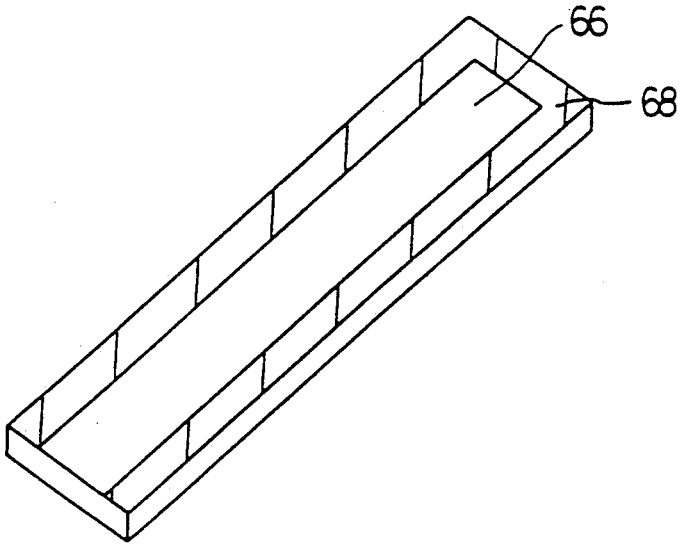
FIG. 10 is a perspective view showing another embodiment with an electrode having a different shape.
Figure 11:
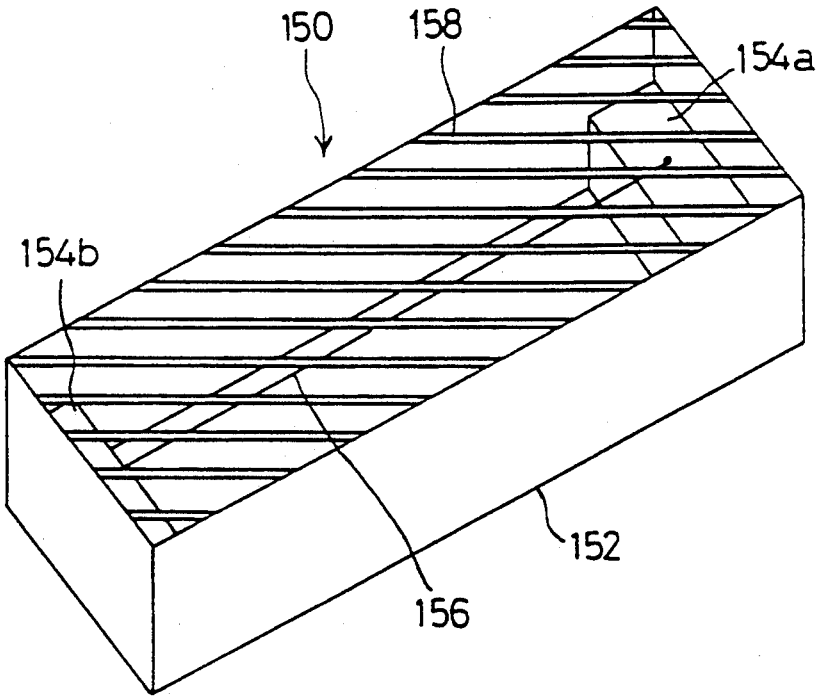
Fig.11 RELATED ART
FIG. 11 is a perspective view of a conventional scorotron electrostatic device.
Figure 12:
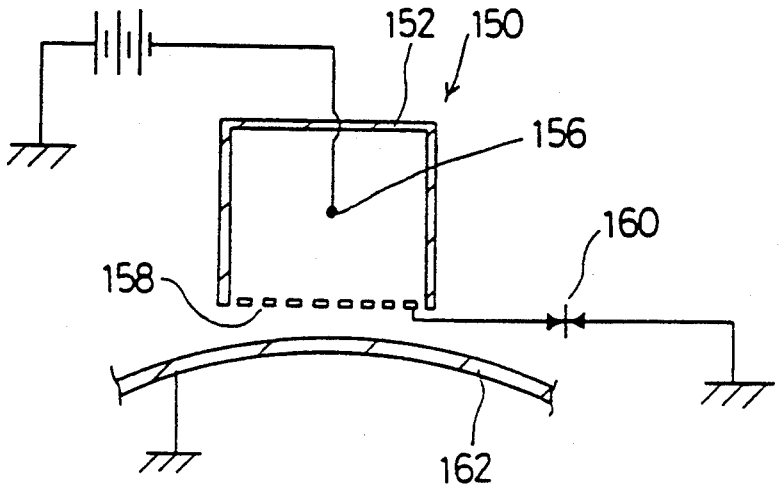
Fig.12 RELATED ART
FIG. 12 is a cross-sectional view of a conventional scorotron electrostatic device.
Figure 13:
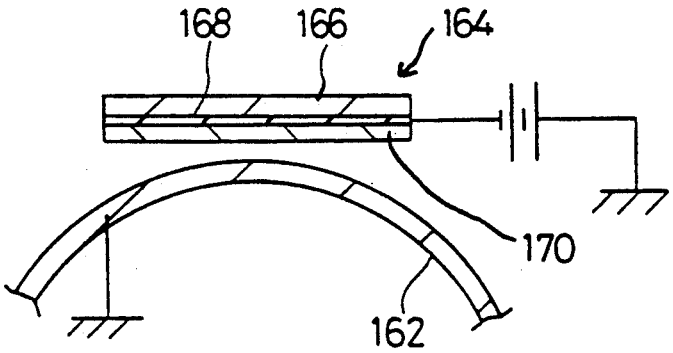
Fig.13 RELATED ART
FIG. 13 is a cross-sectional view of a conventional surface-discharge-type electrostatic device.

The pair of electrodes, shown in FIG. 7, can also be employed in the apparatus as shown in FIG. 4. However, the scope of the invention shall not be limited to the previously described embodiments. The electrodes may also be provided along three sides of the surface of the electrostatic device 72 as shown in FIG. 10.

Further, in the described embodiments, an aluminum tube with photo-sensitized material coated on the surface is used as the latent image holder. However, the scope of the invention is not limited to such. For example, a belt-like photo-sensitized device can be a substituted for the photo-sensitized drum. The invention is also applicable to a so-called electro-fax machine in which electrification, exposure and processing are done directly to the photo-sensitized paper.

What is claimed is:

1. An electrostatic device for electrifying an electrostatic latent image holder, comprising:
   an insulative substrate;
   a resistance film overlaid on the substrate, the resistance film having a side portion; and
   at least one electrode having an area in common with the side portion of the resistance film.

2. The electrostatic device of claim 1, further comprising voltage applying means for applying a voltage to the electrode.

3. The electrostatic device of claim 2, wherein the electrostatic device is provided in parallel with a cylindrically shaped electrostatic latent image holder and electrostatic discharge occurs across the narrowest gap between the electrostatic device and the electrostatic latent image holder.

4. The electrostatic device of claim 3, further comprising:
   supporting means for movably supporting the electrostatic device relative to the electrostatic latent image holder; and
   moving means for moving the electrostatic device in order to control the initial potential on the electrostatic latent image holder.

5. The electrostatic device of claim 4, wherein the resistance between the electrode and the surface of the latent image holder across the narrowest gap is controlled by moving the electrostatic device relative to the latent image holder in a direction at right angles to the length of the latent image holder and within a plane defined by the electrostatic device.

6. The electrostatic device of claim 4, further comprising a controlling means for controlling the moving means according to a specified initial potential on the electrostatic image holder.

7. The electrostatic device of claim 6, further comprising thermo-detecting means for detecting a temperature, wherein the control means controls the moving means based on the specified initial potential on the electrostatic latent image holder and the temperature detected by the thermo-detecting means.

8. The electrostatic device of claim 6, further comprising hygro-detecting means for detecting a humidity, wherein the control means controls the moving means based on the specified initial potential on the electrostatic latent image holder and the humidity detected by the hygro-detecting means.

9. The electrostatic device of claim 1, wherein said electrode is provided on a discharge surface of the resistance film, said electrode having no contact with the substrate.

10. The electrostatic device of claim 9, further comprising an insulation film covering the electrode.

11. The electrostatic device of claim 1, wherein said electrode is provided between said substrate and said resistance film.

12. An electrostatic device for charging an opposing photo-sensitive surface, comprising:
   a planar, insulative substrate having a length at least equal to a width of the photo-sensitive surface;
   a resistance film adhered to a surface of said substrate facing the photo-sensitive surface; and
   at least one electrode extending along a long side of said substrate facing the photo-sensitive surface.

13. The electrostatic device as claimed in claim 12, wherein at said least one electrode overlies a portion of said resistance film along said long side and the electrostatic device further comprises an insulating film overlying said electrode.

14. The electrostatic device as claimed in claim 12, wherein said resistance film overlies said at least one electrode.

15. The electrostatic device as claimed in claim 12, further comprising a second electrode extending along a second long side of said substrate.

16. The electrostatic device as claimed in claim 15, wherein said resistance film overlies both said electrodes.

17. The electrostatic device as claimed in claim 15, wherein both said electrodes overlie said resistance film, the electrostatic device further comprising insulating material overlying each electrode.

18. The electrostatic device as claimed in claim 15, wherein said at least one electrode and said second electrode are interconnected by conductive material along one end of said substrate.

19. The electrostatic device of claim 12, further comprising means for moving said electrostatic device transverse to the width of the photo-sensitive surface while maintaining the narrowest gap between said electrostatic device and the photo-sensitive surface constant.

20. The electrostatic device as claimed in claim 19, further comprising a control means for moving said electrostatic device on the basis of at least one of a detected temperature and humidity.

* * * * *